United States Patent [19]

Harris

[11] 4,393,777

[45] Jul. 19, 1983

[54] HOLDING FIXTURE FOR A HOT STAMPING PRESS

[75] Inventor: Raymond P. Harris, Baltimore, Md.

[73] Assignee: The United States of America as represented by the Administrator of the National Aeronautics and Space Administration, Washington, D.C.

[21] Appl. No.: 225,499

[22] Filed: Jan. 16, 1981

[51] Int. Cl.[3] ..... B41F 21/00

[52] U.S. Cl. ..... 101/407 BP; 269/3

[58] Field of Search ..... 101/407 BP, DIG. 4, 101/3 R, 27, 407 R; 269/1, 287, 2, 4, 265, 241

[56] References Cited

U.S. PATENT DOCUMENTS

| | | | |
|---|---|---|---|
| 131,152 | 9/1872 | Crafts | 29/276 X |
| 855,905 | 6/1907 | Rhoads | 269/3 |
| 1,547,663 | 7/1925 | Nelms | 101/407 BP |
| 1,686,940 | 10/1928 | Tatousek | 101/407 BP |
| 1,799,374 | 4/1931 | Hurley | 269/1 |
| 1,847,473 | 3/1932 | DeRight | 269/3 |
| 2,025,691 | 12/1935 | Mintz | 101/407 BP |
| 2,116,235 | 5/1938 | Curtis | 101/407 BP |
| 2,148,563 | 2/1939 | Kingsley | 101/407 |
| 2,311,433 | 2/1943 | Dershem | 269/3 |
| 2,725,817 | 6/1952 | Kingsley | 101/407 BP |
| 2,790,495 | 4/1957 | Schilha | 101/407 R |
| 2,925,733 | 2/1960 | Kingsley | 137/85 X |
| 3,057,291 | 10/1962 | Smith | 107/407 BP |
| 3,135,198 | 6/1964 | Kingsley | 101/407 BP |
| 3,430,557 | 3/1969 | Peters | 101/407 R |
| 3,567,210 | 3/1971 | Chevillon | 269/287 |
| 4,077,323 | 3/1978 | Liuzzo | 101/407 R |

*Primary Examiner*—Richard J. Apley
*Assistant Examiner*—David J. Isabelle
*Attorney, Agent, or Firm*—John O. Tresansky; John R. Manning; Robert E. Bushnell

[57] ABSTRACT

A hand-held guide 50 for manually positioning a workpiece 58 between the anvil rib 25 and tool 9 of a hot die stamping press. A groove completed by interchangable cover plates 60, 70, 70' attached at one end of the guide conforms to a cross-sectional dimension common to similar workpieces and, with a force fit, retentively holds each of the workpieces.

3 Claims, 8 Drawing Figures

FIG. 1.
(PRIOR ART)
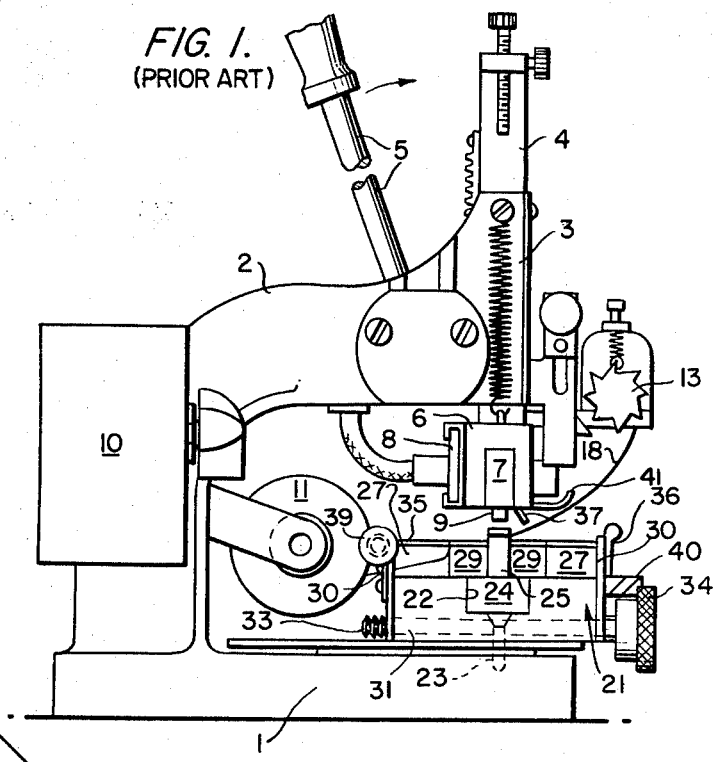
FIG. 2A.
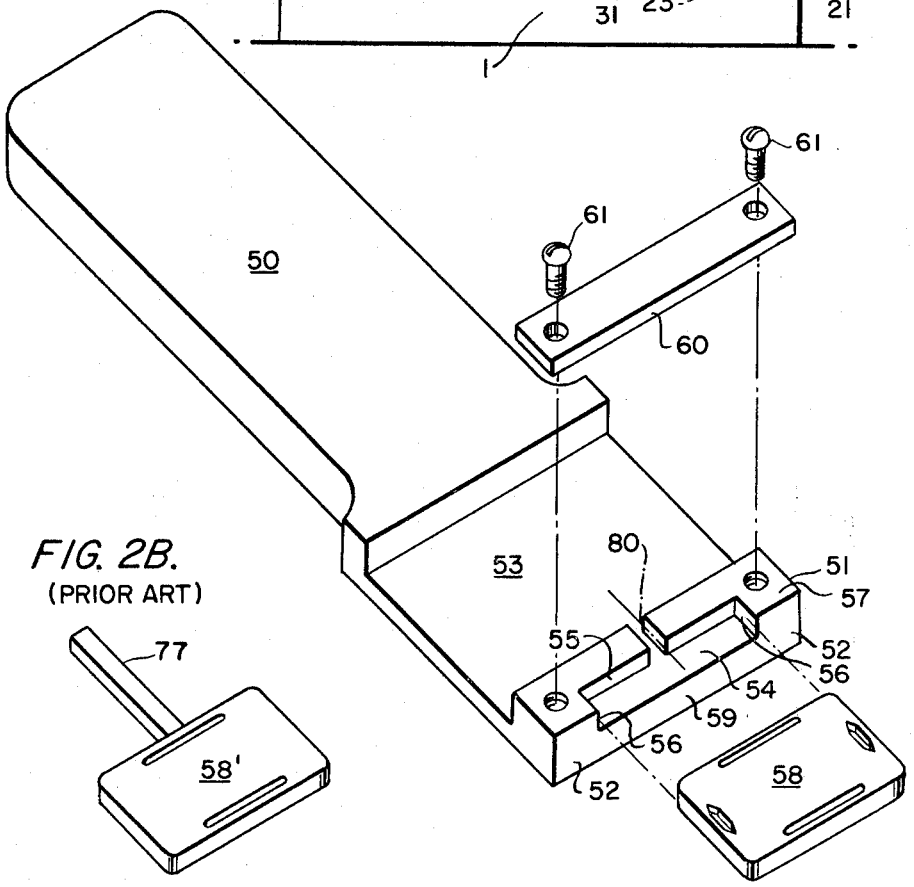
FIG. 2B.
(PRIOR ART)

HOLDING FIXTURE FOR A HOT STAMPING PRESS

ORIGIN OF THE INVENTION

The invention described herein was made by an employee of the United States government and may be manufactured and used by or for the Government for governmental purposes without the payment of any royalties thereon or therefor.

TECHNICAL FIELD

The invention relates to a workpiece support device and, more particularly, to hand maneuvered tool guides for hot die printing.

BACKGROUND ART

Hot die printing is a technique for embossing a workpiece of metal or plastic in a stamping press with a print medium such as leaf foil or carbon black. The workpiece may be either a discrete element such as a plastic identification tag, or a section of a continuous element, such as a length of metal tubing. Usually, a line of type is held by an electrically heated type holder attached to the ram or head of the stamping press. The workpiece, e.g., a laminated plastic identification card presented to the stamping press operator for validation, is positioned on an anvil under the line of type while the print medium is arranged between the line of type and the workpiece. The ram is then lowered, causing the hot line of type to press the print medium against the workpiece. After a short interval, the ram is raised, the embossed workpiece is removed, the print medium advanced, and the technique repeated with another Precision and operator safety are two competing requirements in hot die printing. Precision is required because the location to be embossed on the workpiece is often only a few square millimeters in area; if the workpiece is improperly positioned under the ram the line of type may extend over the edge of the workpiece and make an incomplete impression or overlap into an adjacent location and obliterate a previous impression. Either result is unacceptable, particularly where the attempted impression is sought for identifying the workpiece or the bearer of the workpiece. Efforts for consistent precision in hot die printing usually mean that the stamping press operator manipulates the workpiece while the location to be embossed is approximately aligned in the confined space between the anvil and the ram. For small workpieces, this necessarily exposes the operator to the hazard of touching the hot (200° to 600° F.) print holder, a manifestly undesirable risk to personnel safety.

One exemplar of the type of stamping press used in the prior art is disclosed in Kingsley, U.S. Pat. No. 2,725,817. A fixture attached to a base plate holds a continuous length of workpiece material such as wire rod or tubing in position under the ram of the press. A guide aligns a segment from a roll of print medium between the workpiece and the ram. The fixture has a central channel containing an anvil tailored to the cross-sectional dimension of the workpiece. A central rib runs the length of the anvil. Roller bars disposed above cross channels at either end of the central restrain movement of the material.

Another exemplar is disclosed in the Kingsley U.S. Pat. No. 3,135,198. The stamping press described uses a fixture for holding a continuous length of plastic tape under a heated ram. The guide has a central channel holding a fixture which also contains a central channel. The central channel of the fixture has a width equal to that of the soft material and is partially filled with a cushion.

The chief disadvantage of the workpiece guides and fixtures used in the prior art stamping presses is their unsuitability for accurately positioning discrete workpiece items under the ram. Consequently, hot die stamping press operators are forced to use small tweezers or pliers to align the workpiece, a step that is both time consuming and hazardous. Efforts to use a prior art workpiece guide such as that disclosed in the Crafts, et al. U.S. Pat. No. 131,152, for hot die printing would be fruitless because that style of guide relies upon manual placement of a tool to position the workpiece.

STATEMENT OF INVENTION

Accordingly, it is an object of the present invention to provide a workpiece guide for a stamping press.

It is a second object to provide a guide for accurately positioning a workpiece in a stamping press.

It is another object to provide a guide for affording a stamping press operator a margin of safety while positioning a workpiece.

It is yet another object to provide a simple guide for positioning a workpiece.

It is still another object to provide a simple guide easily adaptable to a variety of workpiece shapes.

Briefly, these and other objects are achieved with a unitary, manually positionable bar with a distal or terminal end suitable for abutting against the anvil of a stamping press and fitted at that end with one of several exchangeable cover plates. One side of the plate defines a groove or channel, either in conjunction with or independently of the distal end of the bar, that conforms to a cross-sectional shape common to a particular class of discrete workpieces. Alternatively, both ends of the bar may be fitted with different plates, each defining a groove or channel conforming to the cross-sectional shape common to different classes of discrete workpieces.

BRIEF DESCRIPTION OF THE DRAWINGS

A more complete appreciation of this invention, and many of the attendant advantages thereof, will be readily achieved as the same becomes better understood by reference to the following detailed description when considered in conjunction with the accompanying drawings in which like references designate the same or similar components, and wherein:

FIG. 1 is a side view of a prior art hot die stamping press.

FIG. 2A is an exploded axonometric projection of one embodiment of the invention.

FIG. 2B is an axonometric view of a prior art workpiece.

DETAILED DESCRIPTION OF THE INVENTION

Figure 3A:
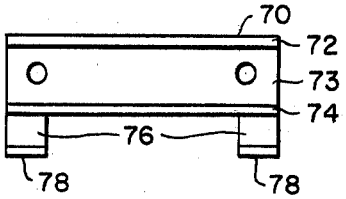
FIGS. 3A and 3B are front and side views, respectively, of an alternative embodiment of a cover plate.

Referring now to the drawings, FIG. 1 is a side view taken from the Kingsley U.S. Pat. No. 2,725,817, of a hot die stamping press suitable for use with the invention. This press includes a base 1 from which extends a gooseneck bracket 2, terminating in a vertically disposed head 3 which carries a ram 4. The ram may be provided with a rack for engagement by a gear, not shown, but adapted to be actuated by an operating lever 5 to cause vertical movement of the ram 4 to and from the base 1. The lower end of the ram is provided with a type or die-receiving head 6 slotted at its underside to receive a type of die holder 7. A suitable electric heater 8 is attached to the head 6 for the purpose of heating the type of die 9 which projects downwardly from the type holder 7. The temperature of the heater may be controlled by a suitable regulator 10 conveniently mounted at one side of the bracket 2.

Supported under the bracket 2 is a foil supply drum 11 which carries a print medium 18 such as ribbon foil adapted to extend under the type 9 and into a ratchet feed device 13 arranged to advance the foil under the type upon reciprocation of the ram.

A base block 21 is adapted to be mounted on the base 1 under ram 4. The base block is provided with a channel 22 in substantially centered relation with the line of type 9. The base block may be held in place by screws 23 exposed at the bottom of the channel 22 and extending into the base 1. The channel 22 is adapted to receive interchangeable anvil bars 24. For example, an anvil bar may be provided with a work supporting rib 25 in registry with the line of type 9 as shown in FIG. 1.

Adjacent each end of the base block, there is provided a cross channel 27. The interchangeable bars 24 may project into the cross channels and are provided with lateral clearance notches. Each cross channel 27 receives a pair of guide jaws 29 which are slideable therein to and from the anvil bar 24.

The front and rear sides of the base block are provided with bearing plates 30 through which journal adjustment screws 31 extending longitudinally in the cross channels 27. The adjustment screws are provided with opposed, that is right and left, screw threads and the lower extremities of the guide jaws are similarly screw threaded. In order to minimize free movement or play of the adjustment screws, their extended ends are provided with compression springs 33. Their opposite, or forward ends, are provided with knobs 34. The adjustment screws are so arranged that they cause the guide jaws 29 to move toward or from each other but to remain substantially equi-distant from the vertical plane passing through the central line of type 9.

Each pair of guide jaws is provided with aligned clearance grooves through which extends a roller bar 35 journaled at its extremities in the bearing plates 30. The roller bars may be retained in place by lever members 36 mounted on the front bearing plate. By moving these levers to one side, the roller bars may be removed as they are unnecessary to the practice of the instant invention.

The rear bearing plate supports a foil guide bar 39, preferably by means of journal brackets, one of which is pivotable so that the foil guide bar may be slipped from the other journal bracket and tilted to facilitate placement of the foil ribbon.

The interchangeable anvil bars 24 are secured in place by thumb screws 40, accessible from the front side of the base block 21.

The structure hereinbefore described may be considered as conventional.

FIG. 2A shows a hand-held guide suitable for positioning a workpiece upon supporting rib 25 of the stamping press of FIG. 1. The guide includes a handle 50 terminating in a distal end 51 having a four sided rectangular slot 54 machined into the terminal portion thereof. A cover plate 60 is rigidly fitted to the top surface of the distal end. The under surface of cover plate 60, in conjunction with the four contiguous sides 54, 55, 56 of the machined slot, define a groove or channel with dimensions selected to accommodate a force fit of a flat, rectangular workpiece 58 having a length and a thickness approximately equal to length and depth, respectively, of slot 54. In practice, cover plate 60 is firmly secured to the top surface 57 of distal end 51 by threaded fasteners 61. Workpiece 58 is gently force fit into the resulting groove formed by the union of cover plate 60 and the top surface of distal end 51. By manually grasping handle 50, the stamping press operator may manually place the abuttment surface against the intersection formed by the right anvil bar 29 and rib 25 of the stamping press of FIG. 1. Assuming an equality of dimensions between the exposed height of rib 25 and the unmachined distal face 59, the bottom surface of the workpiece will be firmly held upon rib 25, aligned directly under the line of type 9 held by die holder 7 of the stamping press. After checking to assure that print medium 18 is between the line of type 9 and workpiece 58, the operator pulls handset 5, causing the hot line of type 9 to press print medium 18 against workpiece 58, thereby embossing the workpiece with whatever characters are represented by line of type 9. Recess 53 merely accommodates a safety shield 37 that descends as ram 7 is lowered to prevent an operator from touching the hot die holder. A guide 41 attached to ram 7 draws print medium 18 downward and across rib 25 and right anvil bar 29 as the ram is lowered.

An alternative type of workpiece 58, such as a plastic identification tag similar to workpiece 58, but having a stem 77, is shown in FIG. 2B. A passage 80 may be provided in the rear side 55 of the groove of distal end 51 to accommodate the stem 77 thereby allowing guide 50 to hold and position workpiece 58' between the anvil and die of the stamping press. Naturally, the lengths of workpieces 58, 58' exceeds the width of the sides 56 of the machined slot while the widths of those workpieces approximately equals or slightly exceeds the width of side 55.

Figure 3B:
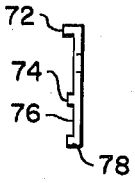
Figure 3C:
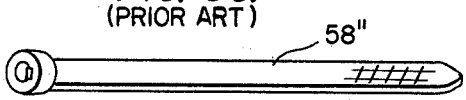
FIG. 3C. (PRIOR ART)
FIG. 3C is a top view of one style of prior art workpiece.

The cover plate 70 of FIGS. 3A and 3B is designed to position a strap or oblong style of workpiece, such as the cable tie 58" shown in FIG. 3C. Flanges 72 and 74 of cover plate 70 form a "C-shape" channel 73 that fits snugly around the edges of top surface 57 of distal end 51. The cover plate may be firmly attached to the top surface by threaded fasteners, such as screws. A web 76 between a third flange 78 and flange 74 defines a second "C-shape" channel approximately equal in width to the width of strap 58" so that after a force fit, strap 58" is retentively held in the channel. Ideally, the widths of web 76 and strap 58" are equal to or slightly greater than the width of rib 25 in the press in order that flanges 74, 78 embrace either side of rib 25, thereby accurately positioning strap 58" upon the rib. The depth of both flanges 74, 78 is preferably greater than the thickness of strap 58''.

Figure 5:
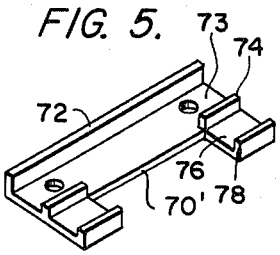
FIG. 5 is an isometric view of an alternative view of a cover plate.

Although cover plate 70 will extend beyond the extremity 51 of the guide, particularly when attached to the guides 50 shown in FIGS. 2A and in 4 where a different type of cover plate 60 is shown. When attached across the extremity of the guide cover plate 70 to form a groove or C-shape channel parallel to the abutment surface 52, 59 of the extremity 51. The cover plate could easily be attached to either side or a top surface of extremity 51 in order to position workpiece 58'' lengthwise into the stamping press. Cover plate 70 may be attached to guide 50 at one extremity 51 with a slot 54, 55, 56 in the manner shown in either of FIGS. 2A or 4, or to an extremity 51 without a slot. Additionally, when used in the manner described on a guide with a slot to position an elongated workpiece such as cable tie 58'', cover plate 70, having a flat surface opposite channels 73, 76, may be reversed, reattached, and used in conjunction with the groove 54, 55, 56, either with channel 76 extending into clearance 53 or beyond distal end 51, to position workpieces such as 58 or 58'. Alternatively, if flange 74 of cover plate 70 is machined so as to have two sections parallel and equal in length to flanges 78, the result will be cover plate 70' of FIG. 5, which may be attached to the guide with top surface 57 adjoining web 73 and used in the same manner as cover plate 70, albeit without the necessity of removal, reversal and reattachment, to position workpieces of the rectangular shape such as 58, 58' or the elongated shape 58'''. The necessity for removing, reversing and reattaching cover plate 70' is avoided because the flange sections 74, 76 do not obstruct the opening to the workpiece receiving slot.

Figure 4:
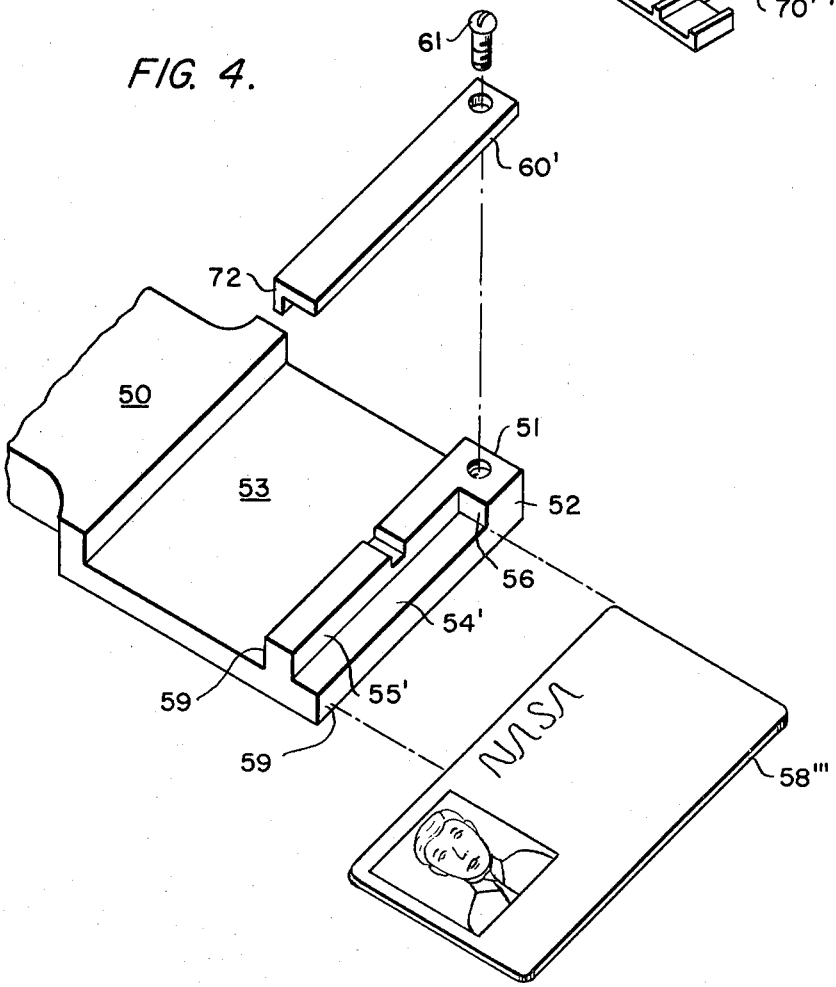
FIG. 4 is an exploded axonometric view of another embodiment of the invention.

The alternative embodiment of the distal end of a guide 50 illustrated in FIG. 4 is designed to hold a large workpiece such as the laminated plastic identification card 58''. Cover plate 60' thereof has a flange 72 which fits against the inward side 59 of the distal end 51. If the depth of the groove, that is, height of sides 55', 56, is equal to or slightly less than the thickness of workpiece 58'', then a force fitting will allow the workpiece to be retentively held by guide 50.

It is apparent from the foregoing that the guide disclosed allows a hot die stamping press operator to accurately, quickly, and safely position a workpiece between the anvil and die without the risk of a misplaced impression or of personal injury. Although the guide is discussed in conjunction with a hot die stamping press holding a line of type, the guide could also be used with a press holding almost any type of tool pressed against an anvil, such as, for example, a center punch. Additionally, the guide is disclosed as holding flat, rectangular workpieces such as plastic identification tags. The guide may be used with workpieces of any stampable material such as metal, acetate, mylar, cardboard, or foil. The workpieces should have uniform cross-sectional dimensions between different pieces, however the workpieces may be irregularly shaped, either identically or differently, with a single uniform cross-section insertable into the groove of distal end 51. Similarly, although the cross-sections of the slots are shown as substantially rectangular, they may have any shape conforming to that of the workpieces. Either the sides of the slot or the adjoining surface of the cover plate may be machined or molded to an irregular shape conforming to that of a class of workpieces. The embodiments discussed shown only one end adapted to hold a workpiece; bar 50 however, may be machined to display a groove and cover plate at both ends, perhaps in order to accommodate two or more different types of workpieces. Finally, the guide may be made from any material, alloy or composition, either metallic, organic or inorganic.

I claim:

1. A fixture for holding a flat, stiff workpiece for contact with a stamp head, comprising:

a unitary member having a generally elongate shape providing a hand graspable section (50) and a planar, distal terminal section (51);

a narrow and elongate slot (54) formed in said planar, distal terminal section having a bottom surface, a rear surface, and at least one side wall said slot being open to the end and top surfaces of said terminal section; and an elongate cover (60) having a flat underside detachably secured to said top surface of said terminal section and forming with said bottom surface, rear surface and said side wall of said slot a continuous force-fit receptacle for a terminal segment of a flat workpiece having a thickness substantially equal to the separation between said underside of said cover and said bottom wall of said slot.

2. The fixture of claim 1 wherein said unitary member includes a recessed portion (53) intermediate of said hand graspable section and said terminal section.

3. The fixture of claim 1 wherein said rear surface of said slot has a passage (80) formed therethrough.

* * * * *